US007231915B2

(12) United States Patent
McPherson

(10) Patent No.: US 7,231,915 B2
(45) Date of Patent: Jun. 19, 2007

(54) DOUBLE SERVING FOR A BOW STRING

(75) Inventor: Mathew A. McPherson, 19055 Incline Rd. Route 2, P.O. Box 58, Norwalk, WI (US) 54648

(73) Assignee: Mathew A. McPherson, Norwalk, WI (US)

( * ) Notice: Subject to any disclaimer, the term of this patent is extended or adjusted under 35 U.S.C. 154(b) by 142 days.

(21) Appl. No.: 11/238,558

(22) Filed: Sep. 29, 2005

(65) Prior Publication Data

US 2007/0068503 A1 Mar. 29, 2007

(51) Int. Cl.
*F41B 5/00* (2006.01)

(52) U.S. Cl. ..... 124/90

(58) Field of Classification Search ..... 124/90, 124/91, 92

See application file for complete search history.

(56) References Cited

U.S. PATENT DOCUMENTS 2,981,053 A * 4/1961 Steele ..... 57/21
3,444,853 A * 5/1969 Hofmeister ..... 124/90
3,714,316 A * 1/1973 Angeloff ..... 264/230
4,319,428 A * 3/1982 Fox ..... 47/42
4,430,851 A * 2/1984 Sundet ..... 57/211
4,957,094 A 9/1990 Pickering et al. ..... 124/24.1
5,538,197 A 7/1996 Killian ..... 242/439.3
5,715,804 A * 2/1998 Izuta ..... 124/90
5,722,385 A 3/1998 Bunk ..... 124/86
5,884,617 A * 3/1999 Nelson ..... 124/90
6,253,754 B1 7/2001 Ward ..... 124/90
6,267,108 B1 7/2001 McPherson et al. ..... 124/25
6,651,643 B2 11/2003 Simonds ..... 124/90
6,712,060 B2 * 3/2004 Egusquiza ..... 124/91
6,886,549 B2 5/2005 McPherson ..... 124/23.1
7,182,079 B2 * 2/2007 McPherson ..... 124/90

OTHER PUBLICATIONS

"Making A Bowstring" Archer's Digest, 5th Edition, 1991, DBI Books.
U.S. Appl. No. 11/064,492, filed Feb. 23, 2005, McPherson.

* cited by examiner

*Primary Examiner*—John A. Ricci
(74) *Attorney, Agent, or Firm*—Vidas, Arrett & Steinkraus, PA

(57) ABSTRACT

Bowstrings and power cables for archery bows have end servings with improved durability and longer life. The servings are doubly wrapped in some areas of the bowstrings and power cables.

20 Claims, 4 Drawing Sheets

DOUBLE SERVING FOR A BOW STRING

FIELD OF THE INVENTION

The present invention relates to archery and bow hunting equipment, particularly to bowstring and power cable construction.

BACKGROUND OF THE INVENTION

It is a recognized practice to apply serving line to the power cables and bowstrings of compound bows, particularly center servings and end servings.

The compound bow uses a series of pulleys (or eccentrics) attached to the ends of the bow limbs. This design allows for increased arrow velocity and reduced force needed to hold the bow at full draw.

However, one concern with a compound bow is that increased wear and reduced life of the bowstrings and buss cables may occur. The increased load pressure applied to the end servings as they are bent by the eccentrics can result in separation of the end servings which can leave the string unprotected and subject to increased wear. Such wear can be even more evident with a single cam bow and high performance twin cam bows because these cam results in even higher load pressure and bending where the high points or steep angles on the eccentric (or cam) contact the end servings.

Typically, a bowstring is assembled from multiple strands and displayed in position for applying serving line to the nock and loop end areas. Such a procedure is described in "Making A Bowstring" Archer's Digest, 5th Edition, 1991, DBI Books.

Servings are typically made of two or more strands of material which are either twisted or braided. They are made from a variety of materials including fishing line material, polyethylene fiber material such as that available under the tradename of SPECTRA®, DACRON® polyester, and KEVLAR® poly-paraphenylene terephthalamide (aramid fiber). The servings are typically applied over the bowstring and/or power cable in a circumferential side-by-side fashion. Center servings and end servings may be applied to the bowstring and/or power cable.

Bowstrings and power cables are typically made using one of two methods. One method consists of laying out multiple strands of a given length of material and then dividing that material at the ends into two or more equal bundles and twisting or braiding these bundles into one single string or rope-like structure. The rope-like structure which is then brought back on itself and is braided or twisted back into the original material to form an end loop.

Power cables, for a single cam system, for example, may be formed by laying out a plurality of strands which are braided or twisted, folding it in half, and then wrapping an end serving around the end loop as well. Power cables for a single cam system also will typically have two smaller loops at the opposite end of the large loop, each of which will also have a small serving.

FIG. 1 from U.S. Pat. No. 6,253,754, the entire content of which is incorporated by reference herein, illustrates a prior art end serving As can be seen, a plurality of strands of bowstring material in a single string or rope-like structure has been brought back on itself to form the end loop 22. An end-serving 12A, has been wrapped around all of the strands in a side-by-side fashion. The serving material is wrapped as tightly as possible. Even though serving material is wrapped very tightly, it is susceptible to separation 23 as bowstring 12 stretches and is subject to the high load pressure of the eccentric. Once separation occurs, the bowstring fibers are left unprotected from the elements and the individual strands of the bowstring can become exposed to dirt and/or dust which can get between the individual strands and eventually wear by the eccentric. The separation is unsightly and, left unprotected, bowstring 12 can become worn and break.

Another method employed may be referred to in the art as an endless string. Using this method, a continuous strand of bowstring material is wrapped around two posts spaced apart at a distance which is approximately equal to that desired for the final bowstring length. The string is wrapped around the two posts until the desired number of strands is reached. The starting and ending point of the string is then tied together forming a splice. A separate piece of bowstring material is then typically wrapped or served over the area of the splice and end loops are formed by folding the served area back on itself and continuing to serve or wrap over the two sides of the string resulting in one multi-stranded bowstring with a loop at each end. The bowstrings thus made are usually held at one end while the other end is rotated to add twists to the main body of the string to bring the overall string length to a desired dimension that will result in the proper functioning of the bow on which the string is to be used.

U.S. Pat. No. 4,957,094, the entire content of which is incorporated by reference herein, discloses buss cables and bowstring which form a continuous length with looped ends.

The information described above is not intended to constitute an admission that such information referred to herein is "prior art" with respect to this invention.

All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

The present invention relates to improved bowstrings and power cables for compound bows having end servings with improved durability and longer life.

In one embodiment, the present invention relates to a double end serving for a bowstring or power cable which exhibits improved strength and durability.

More specifically, a first serving is wrapped off center of a bowstring or power cable, the bowstring or power cable is folded in half such that one half has a long serving and one half has a short serving. A second serving is placed over the short serving and the second serving is wrapped around the long serving, and around the unserved portion of the half of the bowstring or power cable having the short serving.

These and other aspects, embodiments and advantages of the present invention will be apparent to those of ordinary skill in the art upon review of the Detailed Description and Claims to follow.

BRIEF DESCRIPTION OF THE DRAWINGS

A detailed description of the invention is hereinafter described with specific reference being made to the drawings in which.

DETAILED DESCRIPTIONS OF THE PREFERRED EMBODIMENTS

Figure 1:
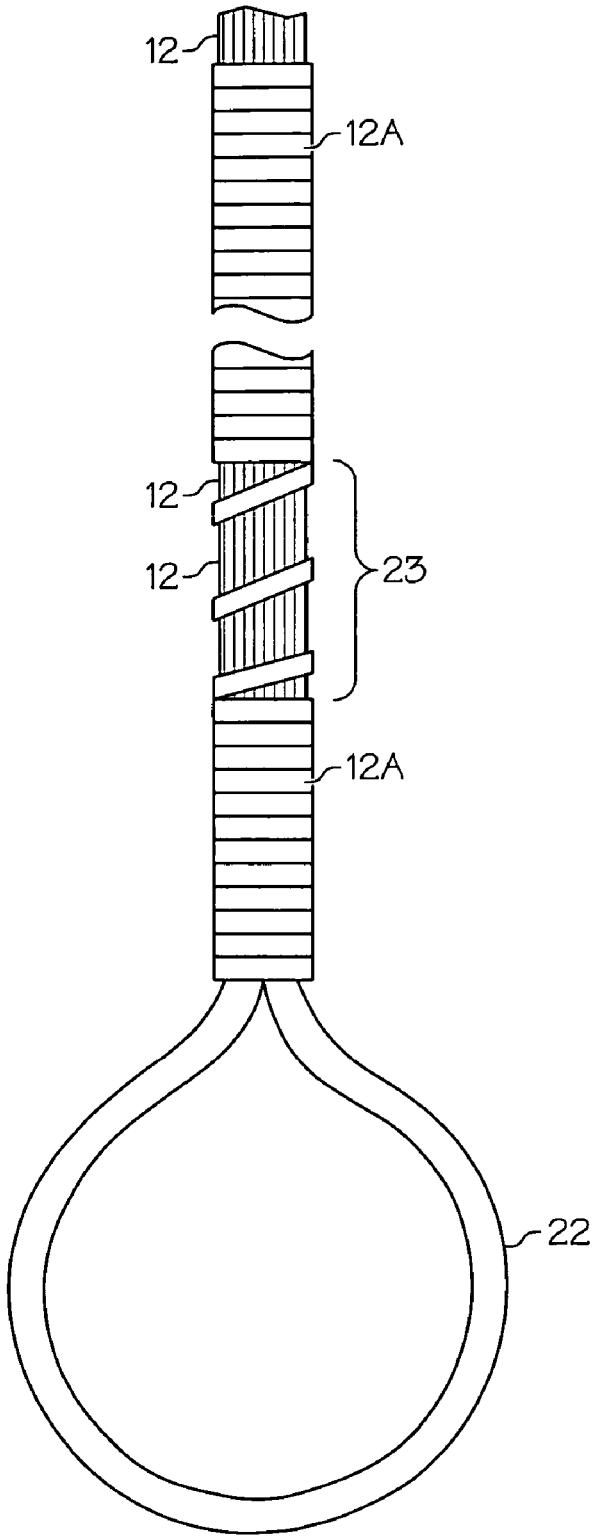
FIG. 1 ( PRIOR ART )
FIG. 1 illustrates a prior art end serving.

While this invention may be embodied in many different forms, there are shown in the drawings and described in detail herein, specific embodiments of the invention. The present disclosure is an exemplification of the principles of the invention and is not intended to limit the invention to the particular embodiments illustrated.

The present invention relates to bowstrings and power cables for archery bows, such as compound bows and cross bows, which have improved servings, particularly improved end servings for improved strength and durability, and therefore longer life. Power cables are sometimes referred to in the art as buss cables. As used herein, the term "cable" shall be used to refer to both power cables and to bowstrings for archery bows.

End servings may be located at several positions on bowstrings and power cables. It should be noted that as used herein, the term end serving may be applied to any portion of the bowstring that comes into contact with an eccentric, idler wheel, cam or the like. The invention is not intended to be limited only to the "end" of the bowstring as the term "end serving" implies.

The end servings are bent by the eccentrics of a bow, such as a compound bow or compound cross bow, and this increased load pressure can result in separation of the end servings which can leave the string unprotected and subject to increased wear.

The term "eccentric" is used here to refer to the rotatably mounted items attached to the ends of the bow limbs. Rotatably mounted items may include idler wheels and cams, for example. The term "eccentric" is not meant to be limited to a particular shape but is meant to refer to any such rotatable device attached to the limb tip of any compound bow known in the art.

As used herein, each cable, or string, shall be used to describe a bundle or plurality of strands, each strand being comprised of at least one fiber or monofilament, Typically, a yarn titer is made up of a plurality of fibers and in turn one or more yarn titers are twisted together to form a strand of bowstring material. The bundle or plurality of strands thus makes up the cable. See commonly assigned U.S. Pat. No. 6,651,643, for example, the entire content of which is incorporated by reference herein.

Figure 2A:
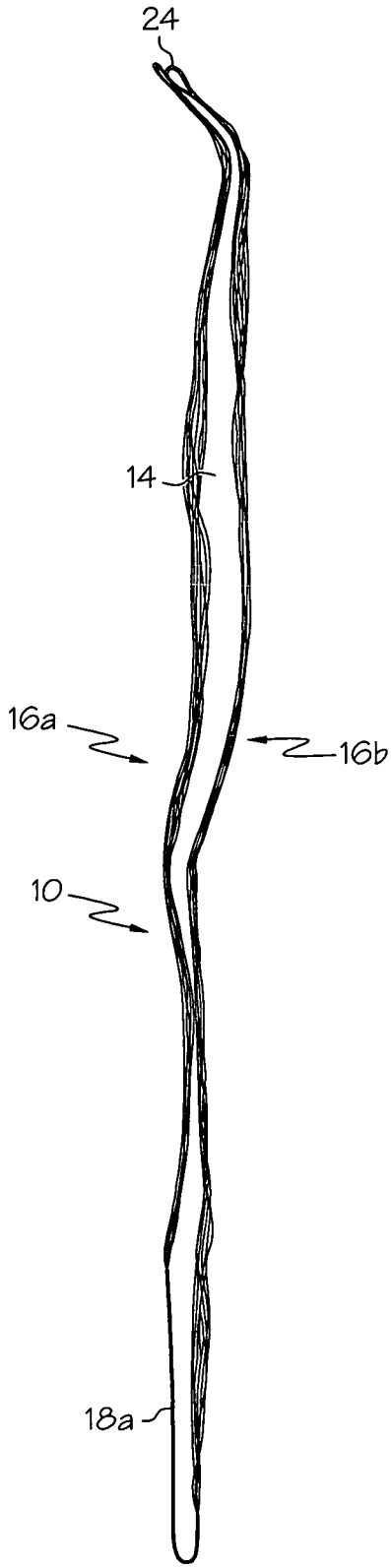
FIGS. 2A and 2B are side perspective views illustrating a method of applying an end serving to a power cable, and resultant served power cable according to the invention.
Figure 2B:
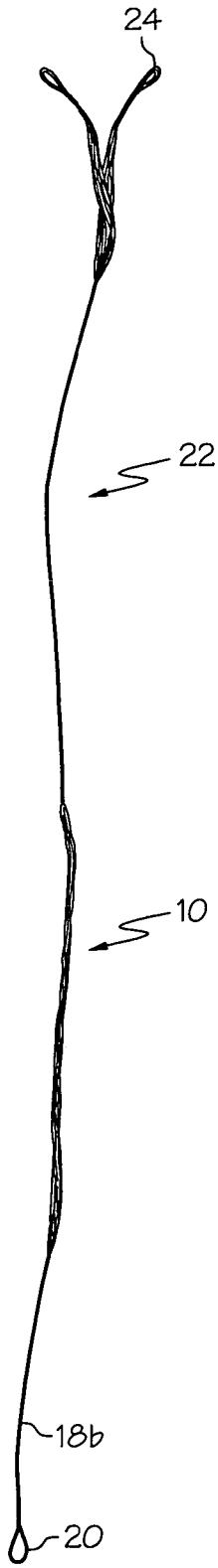

Turning now to the figures, FIGS. 2A and 2B are side perspective views which illustrate a process of serving a power cable 10 according to the invention. In FIG. 2A, a plurality of strands, a single strand designated by reference numeral 14, are laid up together and twisted or braided using any method as is conventional in the art. The laid up strands are then folded into two halves 16*a*, 16*b*. A first serving 18*a* is wrapped off center such that half 16*a* has a longer serving than half 16*b* as shown in FIG. 2A. A second serving 18*b* is then wrapped over the shorter serving portion of half 16*a* as shown in FIG. 2B effectively forming a loop 20 in power cable 10. A third center serving 22 is wrapped proximal to the opposite end of the power cable 10 from loop 20. Power cable 10 has two loops 24 formed at this end. Loop 20 is for securing power cable 10 to a compound bow at the cam end of the compound bow, for example, while loops 24 may secure the power cable 10 to the axle at the limb tip at the opposite end of the bow.

The servings may be secured to the power cable using any method known in the art. One method is disclosed in commonly assigned copending U.S. patent application Ser. No. 11/064,492, the entire content of which is incorporated by reference herein in its entirety. The present invention is not limited by the way in which the servings are secured to the power cable or bowstring.

Figure 3:
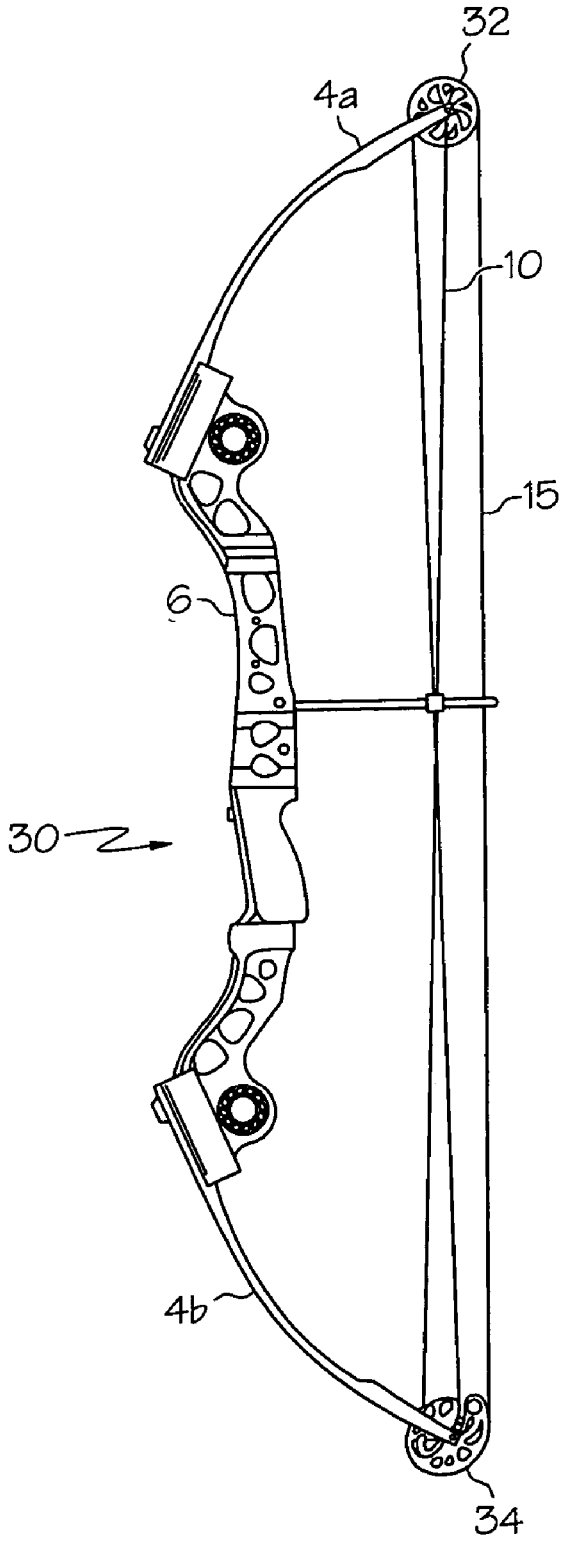
FIG. 3 is a side perspective view of a conventional compound bow having a power cable served according to the invention.

FIG. 3 is a side perspective view of one embodiment of a conventional single cam compound bow 30 having a power cable 10 served according to the invention mounted thereon. Power cable 10 is secured to upper limb 4*a* which is attached to handle 6 of compound bow 30. Securement may be accomplished using any suitable method known in the art. Opposite end of power cable 10 served according to the invention is secured to cam 34 which is secured to lower limb 4*b* of bow limb handle 6 using any suitable method known in the art. In this embodiment, bowstring 15 wraps around both eccentrics, i.e. idler wheel 32 and cam 34, and is positioned typically in grooves (not shown). Either or both ends of bowstring 15 may also be served according to the invention.

Figure 4:
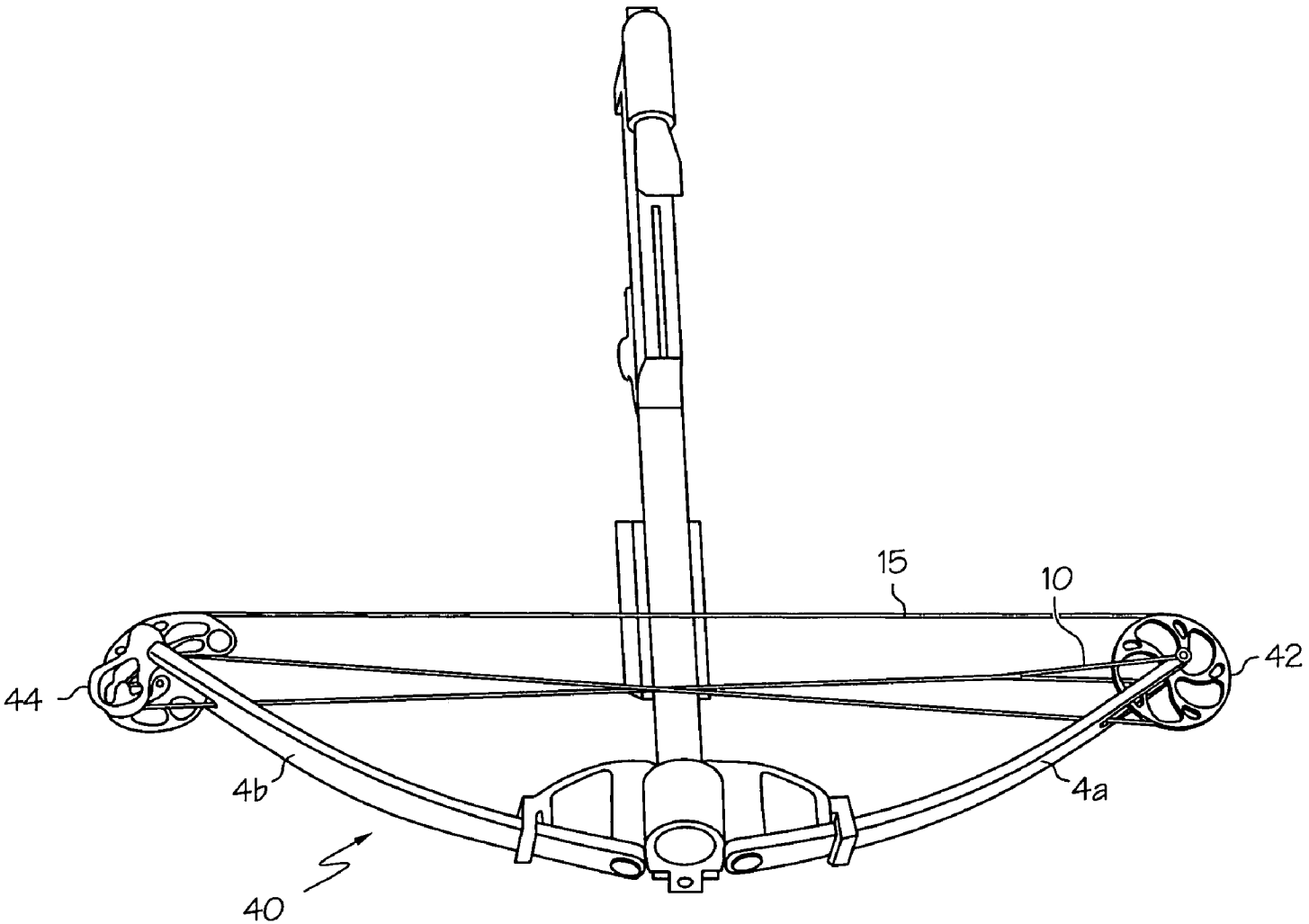
FIG. 4 is a side perspective view of a cross bow having a power cable served according to the invention.

FIG. 4 is a side perspective view of one embodiment of a cross bow 40 having a power cable 10 served according to the invention mounted thereon. Power cable 10 is secured to limb 4*a* of cross bow 40. Securement may be through any method known in the art. Opposite end of power cable 10 served according to the invention is secured to cam 34 which is secured to lower limb 4*b* using any suitable method known in the art. In this embodiment, bowstring 15 wraps around both eccentrics, i.e. idler wheel 32 and cam 34, and is positioned typically in grooves (not shown). Either or both ends of bowstring 15 may also be served according to the invention.

Bowstrings and power cables may be formed from any suitable material including, but not limited to SPECTRA® polyethylene fibers, DACRON® polyester, KEVLAR® poly-paraphenylene terephthalamide (aramid fiber), and so forth. DACRON® fibers are available under the tradename of DACRON® B-50 from BCY Incorporated, for example, wherein the "50" refers to a single strand breaking strength (tensile strength) of about 50 pounds. SPECTRA® 1000 ultra high molecular weight polyethylene fiber available is available from the High Performance Fibers Group of AlliedSignal, Inc. Bowstring material manufactured of SPECTRA® polyethylene is available from Brownell under the tradename of FAST FLIGHT®. Bowstring material manufactured by BCY Inc. is available under the tradename of DynaFLIGHT® 97 which is 100% SK75 DYNEEMA® ultrahigh molecular weight polyethylene and 8125 which is 92% SK75 DYNEEMA®. DYNEEMA® fibers are available from DSM-Toyobo.

Other suitable materials include liquid crystal polymers such as VECTRAN® liquid crystal polymer (LCP) available from Hoechst Celanese Corp. and ZYLON® poly(p-phenylene-2-6-benzobisoxazole) available from Toyobo Co.

Blended fiber bowstrings may also be employed. Examples of blended fiber bowstrings may be found in commonly assigned U.S. Pat. No. 6,651,643, the entire content of which is incorporated by reference herein in its entirety.

A commercially available example of a blended bowstring material is 450 Plus which is a blend of 70% DYNEEMA® SK75 and 30% VECTRAN® fibers available from BCY Inc.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

The invention claimed is:

1. A method of serving a cable of an archery bow, the method comprising the steps of:

a) laying up a plurality of strands of material;

b) wrapping a serving around said plurality of strands which is off-center the plurality of strands;

c) folding said plurality of strands in two forming a first half and a second half, the first half of said plurality of strands has a longer portion of serving than the second half of said plurality of strands;

d) placing a second serving over said short serving; and e) wrapping said second serving around said long serving of said first half, and around an unserved portion of said second half of said plurality of strands wherein a loop is formed at the end of said first half and said second half of said plurality of strands.

2. The method of claim 1 wherein said wrapping step b) is before said folding step.

3. The method of claim 1 wherein said folding step c) is before said wrapping step b).

4. The method of claim 1 further comprising the step of securing said serving to said plurality of strands.

5. The method of claim 1 wherein said cable is a bowstring or a power cable.

6. The method of claim 1 further comprising the step of mounting said cable on an archery bow.

7. The method of claim 6 wherein said archery bow is a compound bow or cross bow.

8. A method of serving a cable for an archery bow, the method comprising the steps of:

a) laying up a plurality of strands of material;

b) folding said plurality of strands in half;

c) wrapping a serving around said plurality of strands which is off-center the plurality of strands, such that when said plurality of strands is folded in half, forming a first half and a second half, the first half of said plurality of strands has a longer portion of serving than the second half of said plurality of strands, and wherein the beginning of the serving is at the longer portion of said first half and the end of the serving is at the shorter portion of said second half of said plurality of strands; and d) wrapping said serving from the end of the serving around said longer portion of said serving of said first half and around an unserved portion of said second half of said plurality of strands, wherein a loop is formed at the end of said first half and said second half of said plurality of strands.

9. The method of claim 8 wherein said wrapping step c) is before said folding step b).

10. The method of claim 8 wherein said folding step b) is before said wrapping step c).

11. The method of claim 8 wherein said cable is a power cable or a bowstring.

12. The method of claim 8 further comprising the step of mounting said cable on an archery bow.

13. A cable for a bowstring comprising a plurality of strands, the plurality of strands having a first serving wrapped around said plurality of strands which is off center of the plurality of strands such that when said plurality of strands are folded into a first half and a second half, the first half has a longer portion of the first serving and the second half having a shorter portion of the first serving, the cable further comprising a second serving, the second serving placed on the shorter portion of the second half of the plurality of strands and the second serving wrapped over said longer portion of the first half and wrapped over an unserved portion of the second half of the cable, the second serving forming an end loop in the cable.

14. The cable of claim 13 in combination with a compound bow or a cross bow.

15. The cable of claim 13 wherein said cable is a power cable or a bowstring.

16. The cable of claim 13 formed from polyolefin fibers, polyester fibers, poly-paraphenylene terephthalamide fibers, liquid crystal polymer fibers, or blends thereof.

17. A cable for an archery bow formed from a plurality of strands, the plurality of strands folded in a first half and a second half, the cable further comprising a first serving, the serving off-center of the cable and wrapped such that the first half has a longer portion of the first serving and the second half has a shorter portion of the first serving, the cable comprising a second serving placed on the shorter portion and wrapped over the first portion and an unserved portion of the second half of the cable, the second serving forming an end loop in the cable.

18. A cable for an archery bow formed from a plurality of strands, the plurality of strands folded in a first half and a second half, the cable further comprising a serving, the serving off-center of the cable and wrapped such that the first half of the cable has a long portion of the serving and the second half of the cable has a short portion of serving, and wherein the serving is further wrapped over the longer portion of the first half and an unserved portion of the second half, the serving forming an end loop in the cable.

19. The cable of claim 18 wherein the serving is formed of two separate units, the first unit forms the off-center serving of the cable, and the second unit of which is wrapped over the longer portion of the first half and the unserved portion of the second half.

20. The cable of claim 18 wherein the serving is tied off at the short portion of the second half of the cable before further wrapping.

* * * * *